US005480144A

United States Patent [19]

Downing

[11] Patent Number: 5,480,144

[45] Date of Patent: Jan. 2, 1996

[54] FOOTBALL WITH BLADDER PROTECTIVE PANEL

[76] Inventor: William J. Downing, Lot 51, Northland Trailer Ct., Ada, Ohio 45810

[21] Appl. No.: 423,937

[22] Filed: Apr. 18, 1995

[51] Int. Cl.[6] ..... A63B 41/04; A63B 41/08

[52] U.S. Cl. ..... 273/65 A; 273/65 B

[58] Field of Search ..... 273/65 R, 65 A, 273/65 B, 65 C, 65 D, 65 EC, 65 ED, 65 F, 58 BA

[56] References Cited

U.S. PATENT DOCUMENTS

| | | | |
|---|---|---|---|
| 1,002,928 | 9/1911 | Pierce . | |
| 1,621,898 | 3/1927 | Pierce | 273/65 A |
| 2,012,376 | 8/1935 | Caro . | |
| 2,078,141 | 4/1937 | Hesper | 273/65 A |
| 2,874,965 | 2/1959 | Martin . | |
| 3,804,409 | 4/1974 | Schachner | 273/65 A X |
| 4,274,633 | 6/1981 | Benscher . | |
| 4,341,382 | 7/1982 | Arnold . | |
| 5,098,097 | 3/1992 | Kennedy et al. . | |

FOREIGN PATENT DOCUMENTS

| | | |
|---|---|---|
| 590480 | 6/1925 | France . |
| 810365 | 8/1951 | Germany . |
| 1084180 | 6/1960 | Germany . |
| 2029706 | 3/1980 | United Kingdom . |
| WO94/23805 | 10/1994 | WIPO . |

*Primary Examiner*—George J. Marlo
*Attorney, Agent, or Firm*—Richard C. Litman

[57] ABSTRACT

An anchoring arrangement for the flap which covers the portion of the bladder of an American football which would otherwise be exposed beneath the laces. The flap is provided with a lateral extension having a hole formed therein. The hole surrounds the inflation valve of the bladder. The flap is encouraged to maintain its location when placed on the bladder during assembly of the football. Glue conventionally employed is eliminated. Elimination of glue solves two problems. One is that glue can dry and fail to secure the flap as intended. The other is that glue clogs holes employed for lacing.

5 Claims, 1 Drawing Sheet

FOOTBALL WITH BLADDER PROTECTIVE PANEL

BACKGROUND OF THE INVENTION

1. FIELD OF THE INVENTION

The present invention relates to a component for assembling a football during fabrication. The component comprises a panel of material positioned below the laces of the football, for protecting the bladder against puncture primarily during fabrication. The panel has a lateral extension for engaging the inflation valve of the football, thus maintaining the novel panel in place during fabrication.

2. DESCRIPTION OF THE PRIOR ART

In the manufacture of inflatable balls having lacing on the exterior, puncture of the bladder is a known hazard. In particular, American footballs are particularly susceptible to puncture due to traditional design in which a longitudinal gap is formed in the cover. This gap would expose a portion of the bladder except for the presence of a flap of material, or protective panel, placed there to remedy this deficiency.

During manufacture of an American football, the panel is set in place, and the assembler maneuvers the bladder into place within the cover, with the protective panel glued in place on the bladder. Two problems arise from this procedure. The first is that as the ball awaits the lacing step, the glue dries, and the panel is no longer secured properly to the bladder. The panel is then free to move out of its intended location, and must be reinstalled and reglued. This problem increases the labor required to assemble a football.

A second problem is that glue is apt to clog the holes that receive the lacing. The clogged holes obstruct the lacing operation.

The prior art fails to address this problem. Constructions of inflatable balls will reveal that while reinforcing or protective panels are known, the present invention is not disclosed. A reference which at first appears to show aspects of the invention is German Pat. Document No. 810,365, dated Aug. 9, 1951. A panel shown therein has upper and lower layers for enveloping a disc which secures a valve tube in a desired condition. Although this panel is located below laces, it functions differently from that of the present invention. In the German document, the panels joined by lacing abut one another. There is no gap as is present in an American football. Thus, the panel is not required to prevent hazardous exposure of the bladder.

U.S. Pat. Nos. 1,002,928, issued to George L. Pierce on Sep. 12, 1911, and 2,874,965, issued to Orville R. Martin on Feb. 24, 1959, both illustrate reinforcing panels. The former invention addresses breakage of the neck of the bladder by covering the same with a protective patch. The latter illustrates a reinforcing lamination located below the laces of a molded rubber football.

U.S. Pat. No. 5,098,097, issued to Thomas Kennedy et al. on Mar. 24, 1992, shows an internal patch serving as a counterweight, for maintaining balance of a ball thrown with spiralling in-flight rotation.

French Pat. No. 590,480, dated Jun. 17, 1925, sets forth a flap for sealing a gap enabling the filling tube of the bladder to exit the cover.

German Pat. Document No. 1,084,180, dated Jun. 23, 1960, describes a flap for covering a valve opening.

These inventions and patents do not teach anchoring of a protective flap for covering an exposed portion of a ball bladder by engagement with the valve structure of the bladder. Thus, none of the above inventions and patents, taken either singly or in combination, is seen to describe the instant invention as claimed.

SUMMARY OF THE INVENTION

The present invention solves several problems associated with the manufacturing of American footballs. As described above, gluing the protective panel in place during manufacturing leads to failure of the glue and to clogging of lacing holes.

In place of conventional strips of material employed as protective panels, the present invention includes an extension of the material having a hole formed therein. This extension serves as a yoke when placed over the valve of the bladder. The yoke substantially maintains the protective panel in place as the bladder is inserted into the cover. With the protective panel thus engaging and being anchored by the bladder, gluing is not required.

In a preferred construction, the protective panel is configured to employ minimal material, since all excess material will render the panel more difficult to manipulate during assembly, and will also tend to unbalance the resultant football. As described in U.S. Pat. No. 5,098,097, to Kennedy et al, unbalancing will degrade the performance of the football when thrown.

Accordingly, it is a principal object of the invention to provide a protective panel for the portion of a football bladder which would be exposed beneath the laces, which panel is anchored to the football by mechanical engagement therewith.

It is another object of the invention to eliminate gluing in place of a protective panel during assembly of a football.

It is a further object of the invention to design a protective panel to employ minimal material, thereby making the panel easier to manipulate into place during manufacture, and minimizing the weight of the panel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
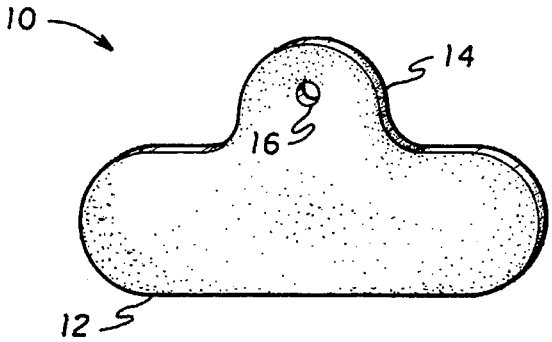
FIG. 1 is a perspective view of the invention.
Figure 2:
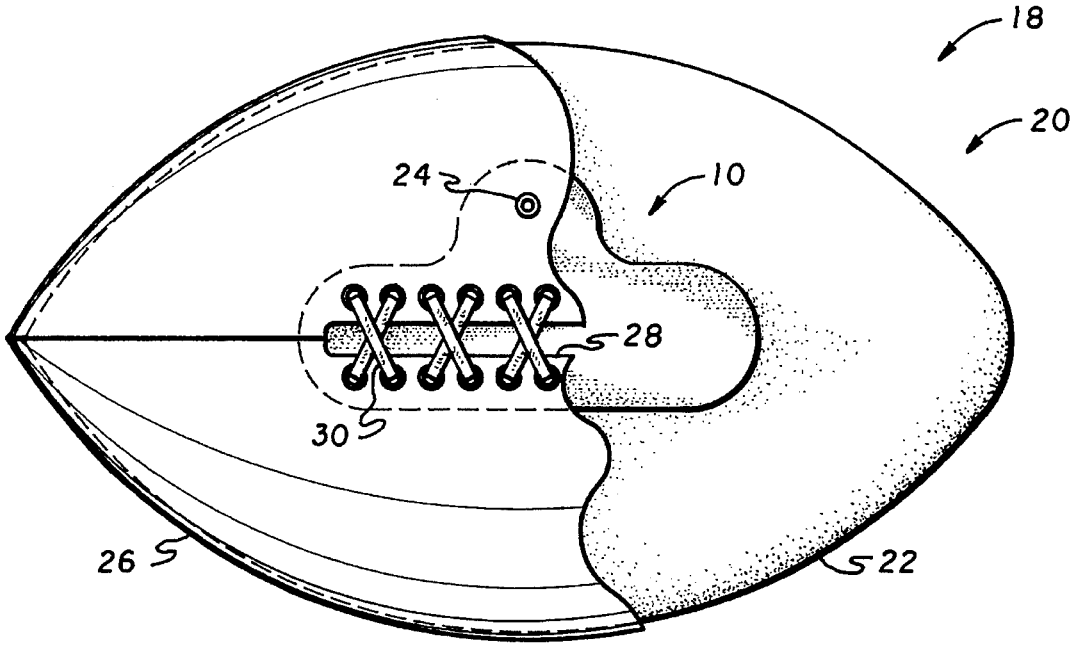
FIG. 2 is an environmental, side elevational view of the invention, with environmental elements partly broken away for clarity.

FIG. 1 shows the construction of the novel protective panel 10. Panel 10 includes an elongated section 12 and a lateral projection 14. Projection 14 includes a hole 16.

Panel 10 is shown in place on a football 18, after assembly of the latter. Football 18 has a bladder 20 including a flexible, inflatable bag 22 and a valve 24 projecting outwardly therefrom.

A cover 26 surrounds bladder 20, and is formed from a plurality of panels sewn together. Rather than abutting continuously at all edges, two panels are formed to define a longitudinally oriented gap 28 therebetween, to enable insertion of bladder 20 during assembly. Gap 28, if not covered, would expose bladder 20. Laces 30 cross gap 28 to prevent excessive separation from adjacent cover panels. Panel 10 is placed between bladder 20 and cover 26 in such a position as to cover gap 28 after final assembly.

During assembly and prior to final inflation of bladder 20, projection 14 is placed into surrounding engagement with valve 24. This is accomplished by passing valve 24 through hole 16 of projection 14. Projection 14 extends to and beyond valve 24, so that after engagement with valve 24, longitudinal section 12 is not withdrawn from its effective location beneath gap 28.

Hole 16 is of a predetermined close fit cooperating with the outer diameter of valve 24. If the material from which panel 10 is fabricated is not resilient, then hole 16 is of a diameter close to that of valve 24. If a resilient material is chosen, then the diameter of hole 16 may be slightly smaller than that of valve 24. It is desired that projection 14 not be allowed significant play with respect to valve 24, which play could allow section 12 to easily move from its desired position. However, a tight fit is not required to limit play between projection 14 and valve 24, and thus to anchored panel 10 in place within the football during assembly.

Panel 10 is made from a flexible material, so that it can be appropriately manipulated during assembly, and so that it can conform to the configuration of the football during use. Under conditions of use, a football can sustain hard impacts which temporarily distort the characteristic shape.

Conditions of use, including impacts, vibration, temperature changes, and others, could also dislodge panel 10 from its position between bladder 20 and cover 26. To prevent dislodging, panel 10 is preferably formed to dimensions greater than those of gap 28, panel 10, thereby overlapping gap 28.

Section 12 is of continuous construction, in the sense of lacking perforations, slits, or other disruptions to continuity, so as to cover bladder 20 fully, and provide an effective barrier to external objects which might puncture bladder 20. Projection 14 serves as a tether, and need not have continuous construction.

Figure 3:
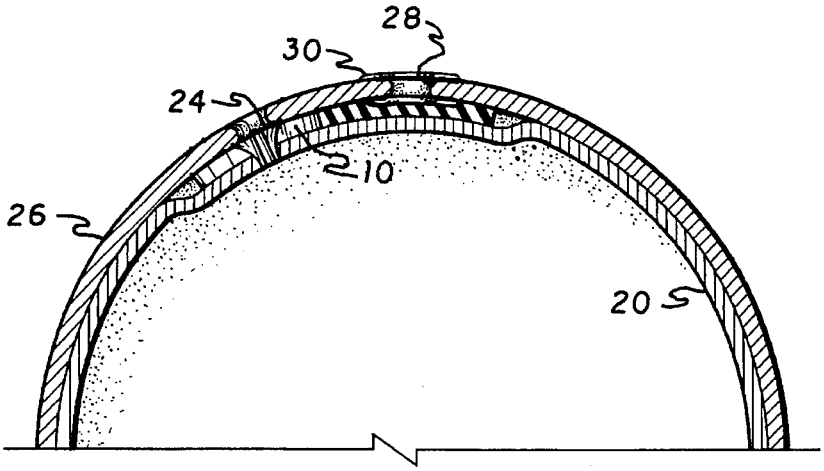
FIG. 3 is an environmental, cross sectional view of the invention.

To minimize size of panel 10, it comprises section 12, longitudinally oriented in order to align with gap 28, and projection 14 projects laterally therefrom. Section 12 terminates below cover 26 in the sense that it does not cover a greater surface area of bladder 20 than is necessary to perform its protective function. This limitation in area helps to maintain weight distribution of the football, panel 10 contributing little more than weight offsetting that lost in the formation of gap 28. FIG. 3 illustrates overlapping of panel 10 with respect to gap 28. The limited surface area of bladder 20 can also be seen in this Figure.

It is to be understood that the present invention is not limited to the sole embodiment described above, but encompasses any and all embodiments within the scope of the following claims.

I claim:

1. A football comprising:

a bladder having a flexible, inflatable bag and a valve projecting outwardly therefrom;

a cover surrounding said bladder, said cover having means defining a longitudinally oriented gap therein exposing said bladder, said cover having laces crossing said gap; and a flexible protective panel disposed between said bladder and said cover, and covering said gap and terminating below said cover, and having means defining an opening engaging said valve.

2. The football according to claim 1, said protective panel having a solid and continuous longitudinally oriented section closing said gap, and a lateral projection extending to and beyond said valve, said opening engaging said valve being located on said lateral projection.

3. The football according to claim 1, said opening being of predetermined close fit with respect to the outer diameter of said valve.

4. The football according to claim 1, said panel overlapping said gap, whereby said gap is effectively sealed when said football is in use.

5. A football comprising:

a bladder having a flexible, inflatable bag and a valve projecting outwardly therefrom;

a cover surrounding said bladder, said cover having means defining a longitudinally oriented gap therein exposing a said bladder, said cover having laces crossing said gap; and a flexible protective panel disposed between said bladder and said cover, and covering and overlapping said gap, and terminating below said cover, said protective panel having a continuous, longitudinally oriented section closing said gap, and a lateral projection extending to and beyond said valve, said lateral projection having means defining an opening located on said lateral projection, said opening being of predetermined close fit with respect to the outer diameter of said valve, for surroundingly engaging said valve.

* * * * *